US009994376B2

(12) United States Patent
De Soto-Burt et al.

(10) Patent No.: US 9,994,376 B2
(45) Date of Patent: Jun. 12, 2018

(54) PACKAGE COMPRISING A PLURALITY OF INDIVIDUALLY WRAPPED ARTICLES

(71) Applicant: The Procter & Gamble Company, Cincinnati, OH (US)

(72) Inventors: Widalys Luz De Soto-Burt, Loveland, OH (US); Gregory James Wilson, New Gloucester, ME (US); Charlotte Fausett, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 227 days.

(21) Appl. No.: 14/465,864

(22) Filed: Aug. 22, 2014

(65) Prior Publication Data

US 2015/0114866 A1 Apr. 30, 2015

Related U.S. Application Data

(60) Provisional application No. 61/896,672, filed on Oct. 29, 2013.

(51) Int. Cl.

| | |
|---|---|
| ***B65D 75/04*** | (2006.01) |
| ***B65D 75/46*** | (2006.01) |
| ***B65D 75/58*** | (2006.01) |
| *B65B 61/02* | (2006.01) |

(52) U.S. Cl.

CPC ..... *B65D 75/04* (2013.01); *B65D 75/46* (2013.01); *B65D 75/5827* (2013.01); *B65B 61/025* (2013.01)

(58) Field of Classification Search

CPC ..... B65D 75/04; B65D 75/58; B65D 75/46; B65D 75/5827; B65D 5/4212; B65D 5/425; A61F 13/551; A61F 13/55175; A61F 13/5514; A61F 13/5513

USPC ..... 206/440, 441, 459.5; 229/87.05; 604/385.02

See application file for complete search history.

(56) References Cited

U.S. PATENT DOCUMENTS

| | | | | | |
|---|---|---|---|---|---|
| 582,925 | A * | 5/1897 | Johnson | A61F 13/2051 | 206/440 |
| 2,057,122 | A * | 10/1936 | Trevellyan | B65D 75/527 | 15/229.12 |
| 2,105,367 | A * | 1/1938 | Parsons | B65D 75/5844 | 206/410 |
| 2,285,542 | A * | 6/1942 | Tasker | B65D 75/5833 | 229/237 |

(Continued)

FOREIGN PATENT DOCUMENTS

| | | | |
|---|---|---|---|
| EP | 0597446 | A1 | 5/1994 |
| JP | 2003-054576 | A | 2/2003 |

(Continued)

OTHER PUBLICATIONS

PCT International Search Report, dated May 7, 2015, 105 pages.

*Primary Examiner* — Steven A. Reynolds

(74) *Attorney, Agent, or Firm* — George H. Leal; Andrew J. Hagerty

(57) ABSTRACT

Packages containing a plurality of individually wrapped articles are described. The wrappers comprise at least two different printed elements, and the appearance of the individually wrapped articles can vary within a single package. Methods for individually wrapping a plurality of articles are also described.

20 Claims, 9 Drawing Sheets

(56) References Cited

U.S. PATENT DOCUMENTS 2,335,198 A * 11/1943 Smith ..... B65D 77/2012 206/459.5
2,391,301 A * 12/1945 Dukehart, Jr. ..... B65D 83/0811 206/441
2,647,334 A * 8/1953 Wilsher ..... B65D 75/38 229/87.05
3,528,825 A * 9/1970 Doughty ..... A22C 13/023 134/22.11
4,648,513 A * 3/1987 Newman ..... A61F 13/55175 229/87.05
5,458,235 A * 10/1995 Stone ..... B65D 5/4204 206/232
6,036,679 A * 3/2000 Balzar ..... A61F 13/5514 206/438
6,138,905 A * 10/2000 Hachenski ..... B65D 5/5425 206/459.5
6,318,555 B1 * 11/2001 Kuske ..... B65D 75/522 206/459.5
6,454,095 B1 * 9/2002 Brisebois ..... A61F 13/551 206/440
6,601,705 B2 * 8/2003 Molina ..... A61F 13/551 206/440
6,669,021 B1 * 12/2003 Spielman ..... B65D 75/38 206/457
6,681,934 B2 * 1/2004 Kolterjohn ..... A61F 13/47209 206/438
6,688,466 B2 * 2/2004 White ..... A61F 15/001 206/440
6,763,944 B2 * 7/2004 Ronn ..... A61F 13/84 206/440
6,957,738 B2 * 10/2005 Hammond ..... A61F 17/00 206/425
7,621,106 B2 * 11/2009 Tackett ..... A61F 13/55175 206/440
7,886,904 B1 2/2011 Evans
8,070,359 B2 * 12/2011 Taheri ..... B29C 66/432 383/105
8,197,455 B2 6/2012 Zander et al.
8,220,632 B2 * 7/2012 Oi ..... A61F 13/551 206/440
8,286,793 B2 * 10/2012 Kondo ..... A61F 13/20 206/438
8,302,844 B2 * 11/2012 McConnell ..... A61F 13/551 229/87.05
8,348,916 B2 * 1/2013 Fujikawa ..... A61F 13/55175 383/203
8,419,700 B2 * 4/2013 Fung ..... A61F 15/003 604/385.02
8,899,418 B2 * 12/2014 Francis ..... A61F 13/55175 206/440
2002/0170841 A1 * 11/2002 Persson ..... A61B 50/37 206/440
2003/0065300 A1 * 4/2003 Suga ..... A61F 13/55185 604/385.02
2003/0073970 A1 * 4/2003 Suga ..... A61F 13/5518 604/385.02
2003/0220624 A1 * 11/2003 Domeier ..... A61F 13/34 604/385.02
2004/0134822 A1 * 7/2004 Otsubo ..... A61F 13/49001 206/440
2004/0238393 A1 * 12/2004 Ohi ..... A61F 13/5611 206/438
2005/0148979 A1 * 7/2005 Palma ..... A61F 13/551 604/385.02
2005/0209576 A1 * 9/2005 Hirotsu ..... A61F 13/551 604/385.02
2005/0288644 A1 12/2005 Mizutani et al.
2006/0167425 A1 * 7/2006 Stellbrink ..... A61F 13/55175 604/385.01
2007/0102316 A1 * 5/2007 Van Der Krogt .. B65D 21/0202 206/459.5
2007/0151885 A1 * 7/2007 Loyd ..... A61F 13/55185 206/440
2007/0267322 A1 * 11/2007 Kishida ..... A61F 13/551 206/776
2008/0000793 A1 * 1/2008 Messerschmidt ..... A61F 15/001 206/459.5
2008/0053857 A1 * 3/2008 Albano ..... B65D 33/004 206/459.5
2008/0099360 A1 * 5/2008 Smith ..... B65D 5/4212 206/459.5
2008/0272182 A1 * 11/2008 Hanten ..... A22C 13/00 229/87.05
2009/0065560 A1 * 3/2009 Johnson ..... B65D 5/4216 229/103.2
2009/0188825 A1 * 7/2009 McConnell ..... B65D 5/5425 206/440
2009/0247981 A1 * 10/2009 Glaug ..... A61F 13/55185 604/385.02
2010/0000897 A1 * 1/2010 Bumpass ..... A61F 13/26 206/440
2010/0147718 A1 * 6/2010 Ruman ..... B65D 5/62 206/438
2010/0243500 A1 * 9/2010 McConnell ..... A61F 13/55185 206/440
2010/0320115 A1 * 12/2010 Perry ..... A61F 13/55175 206/581
2011/0024317 A1 * 2/2011 Evans ..... B65D 75/5827 206/388
2011/0024319 A1 * 2/2011 Krautkramer ..... A61F 13/55145 206/438
2011/0120897 A1 * 5/2011 Takahashi ..... A61F 13/51496 206/459.5
2011/0132976 A1 * 6/2011 Drewnowski ..... A61F 13/15747 229/87.05
2011/0139656 A1 * 6/2011 Nukuto ..... B65D 5/4204 206/459.5
2011/0184367 A1 * 7/2011 Toms ..... A61F 13/551 604/385.02
2012/0043244 A1 * 2/2012 Hagner ..... A61F 13/496 206/459.5
2012/0213456 A1 * 8/2012 Sugiyama ..... B65D 75/5805 383/207
2012/0305576 A1 * 12/2012 Oates ..... B65D 75/52 220/660
2012/0310201 A1 * 12/2012 Oates ..... A61F 13/5514 604/385.02
2013/0220860 A1 * 8/2013 Bacon ..... B65D 25/54 206/457

FOREIGN PATENT DOCUMENTS

JP 2006-290381 A 10/2006
JP 1288171 12/2006
WO WO-00/59801 A1 10/2000

* cited by examiner

PACKAGE COMPRISING A PLURALITY OF INDIVIDUALLY WRAPPED ARTICLES

FIELD OF THE INVENTION

The present invention is directed to packages comprising a plurality of individually wrapped articles. The present invention is also directed to methods for individually wrapping a plurality of articles.

BACKGROUND OF THE INVENTION

An article's wrapper can be a very important component for consumers when selecting which article brand to purchase. The opening feature of the wrapper can be especially important because it typically impacts the usage experience. An ideal wrapper is one where the consumer is able to easily detect where and/or how the wrapper opens. This can reduce the time needed for the consumer to locate the opening, ensure that the consumer opens it correctly, and/or enable the consumer to use the wrapper for discarding a used article. As an example, being able to retrieve a tampon applicator from the proper side of a wrapper is important because it helps keep the insertion end of the applicator clean.

It is common for wrappers of personal care articles to contain printed designs so as to provide a level of discreetness. Some manufacturers of personal care articles have begun packaging a plurality of individually wrapped articles into a secondary package wherein there is more than one design on the various wrappers. Multiple designs for a given article wrapper can add to discreetness and can simply delight consumers towards a purchasing decision of a particular brand of articles. However, the manner in which the wrapper designs are configured can lead to complexity in manufacturing and packaging the wrapped articles. For example, some secondary packages contain wrapped articles having multiple designs wherein the individually wrapped articles are manufactured on separate converting lines and then routed into a package module that is fed from the different article converting lines.

Embodiments of the present invention are designed to provide both a plurality of wrappers with a variety of design appearances that can be manufactured on a single converting line and an indication of where to appropriately open the wrappers.

BRIEF DESCRIPTION OF THE DRAWINGS

The following detailed description of specific embodiments of the present invention can be best understood when read in conjunction with the drawings enclosed herewith.

Figure 1:
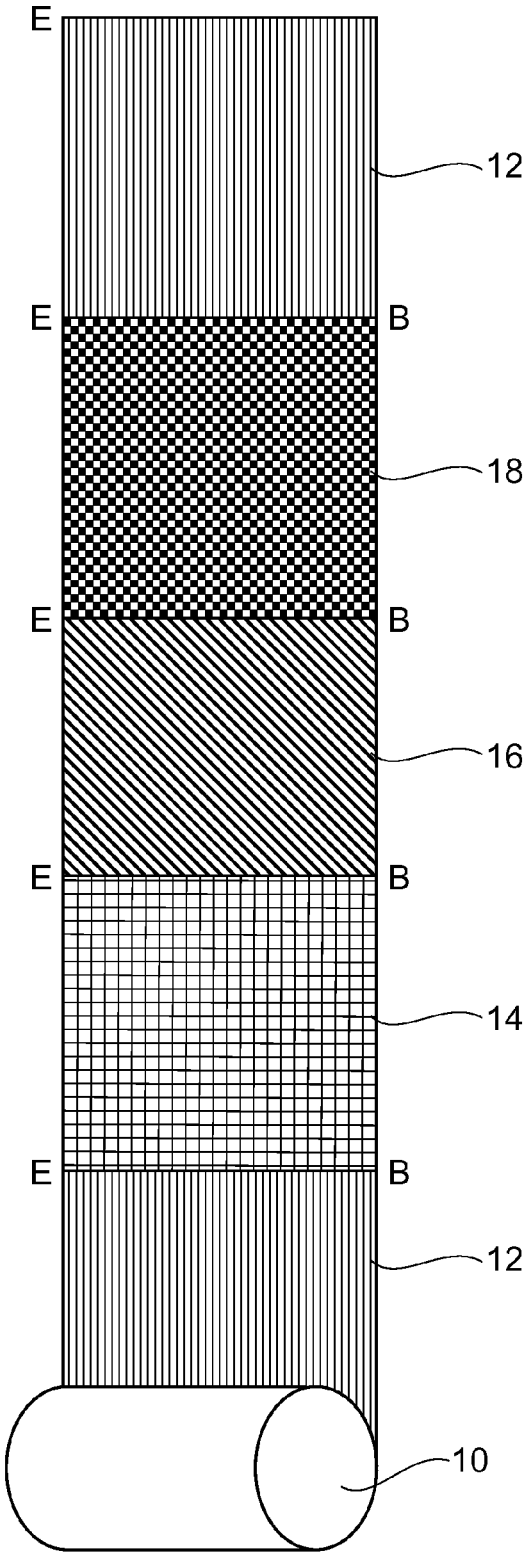
FIG. 1 is a plan view of a wrapper feedstock embodiment according to the present invention.

The embodiments set forth in the drawings are illustrative in nature and not intended to be limiting of the invention defined by the claims. Moreover, individual features of the drawings and invention will be more fully apparent and understood in view of the detailed description.

DETAILED DESCRIPTION OF THE INVENTION

The following text sets forth a broad description of numerous different embodiments of the present invention. The description is to be construed as exemplary only and does not describe every possible embodiment since describing every possible embodiment would be impractical, if not impossible. And it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims. All publications and patents cited herein are incorporated herein by reference.

It should also be understood that, unless a term is expressly defined in this specification using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential to the present invention unless so stated. To the extent that any term recited in the claims at the end of this patent is referred to in this patent in a manner consistent with a single meaning, that is done for sake of clarity only so as to not confuse the reader, and it is not intended that such a claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

The present invention is directed to methods for individually wrapping a plurality of articles and to packages containing the same. The wrappers generally at least partially enclose the article prior to the article's use, and in some embodiments, the wrappers may be configured to receive a used article (or portion thereof) for disposal purposes. The type of articles contemplated by the present invention is unlimited. One exemplary type of article is a personal care article. Some examples of personal care articles include, but are not limited to, absorbent articles such as diapers, sanitary napkins, pads, pantiliners, adult incontinence products (pads, briefs, and pessaries), tampons, wipes, and any other article that is useful in managing and/or controlling the discharge of bodily fluids. The articles can be disposable, semi-durable, or durable. As used herein, the term "disposable" means single use. "Intravaginal device", as that term is used herein, includes tampons and incontinence products (e.g., a pessary) that are at least partially inserted into the vaginal canal Any known packaging material substrate can be used for the wrapper material, including, for example, polymeric films, fibrous materials (including nonwovens and wovens), paper, card stock, and combinations thereof. In one preferred embodiment, the wrapper material substrate comprises flexible, polymeric films. The polymeric films may be based on polyethylene, polypropylene, polyester, nylon, polyvinyl alcohol, or blends of the same. One exemplary material is a 32 gauge polyethylene film. The wrapper materials may be a single layer or more than one layer; for example, a multi-layered co-extruded film or film/nonwoven laminate.

The methods for individually wrapping a plurality of articles generally employ a wrapper material feedstock that comprises a substrate that includes multiple different printed elements that repeat (orderly or randomly) along the length of the substrate. As used herein, the term "printed element" includes but is not limited to a color, a geometrical shape, a character, a symbol, a letter, text, a pattern, a design, and combinations thereof. As used herein, the term "different printed element" is intended to mean that there is at least one aspect of the printed element which is different. A different printed element can include, for example, objects which are not the same size, colors which are not the same, a change in spatial orientation of objects of the printed element, or other aspects which make it apparent to the consumer that the printed elements are different. The printed elements can be printed with any process known to those skilled in the art. Exemplary printing systems include gravure printing, offset printing, inkjet printing, V-printing (see, e.g., U.S. Pat. No. 7,731,331) and combinations thereof.

The substrate can be pre-printed or printed on the packaging line that is individually wrapping the articles. Referring to FIG. 1, one exemplary wrapper material feedstock 10 is shown that includes four different printed elements 12, 14, 16, and 18 that repeat in order along the length of feedstock 10. Each of the printed elements has a beginning B and an end E; for example, the end E of printed element 12 (noted on the left hand side of FIG. 1) is the beginning B of printed element 14 (noted on the right hand side of FIG. 1). As shown in FIG. 1, printed elements 12, 14, 16, and 18 are arranged in abutting fashion such that the end E of one printed element is the beginning B of an adjacent printed element. In alternative embodiments, the printed elements can have a gap between them. The methods include a step of at least partially enclosing an article and cutting the feedstock substrate to define individual wrapper materials. These steps can be done serially (in any order) or simultaneously. For example, multiple articles can be enclosed or partially enclosed by portions of the feedstock and the feedstock then manipulated further (e.g., sealed) and cut to define the final wrapped articles. Or portions of the feedstock can be cut into individual wrapper materials prior to enclosing/inserting the articles to be wrapped. Processing steps recited in appended method claims can be done in multiple orders (including simultaneously) unless otherwise explicitly noted.

Figure 2:
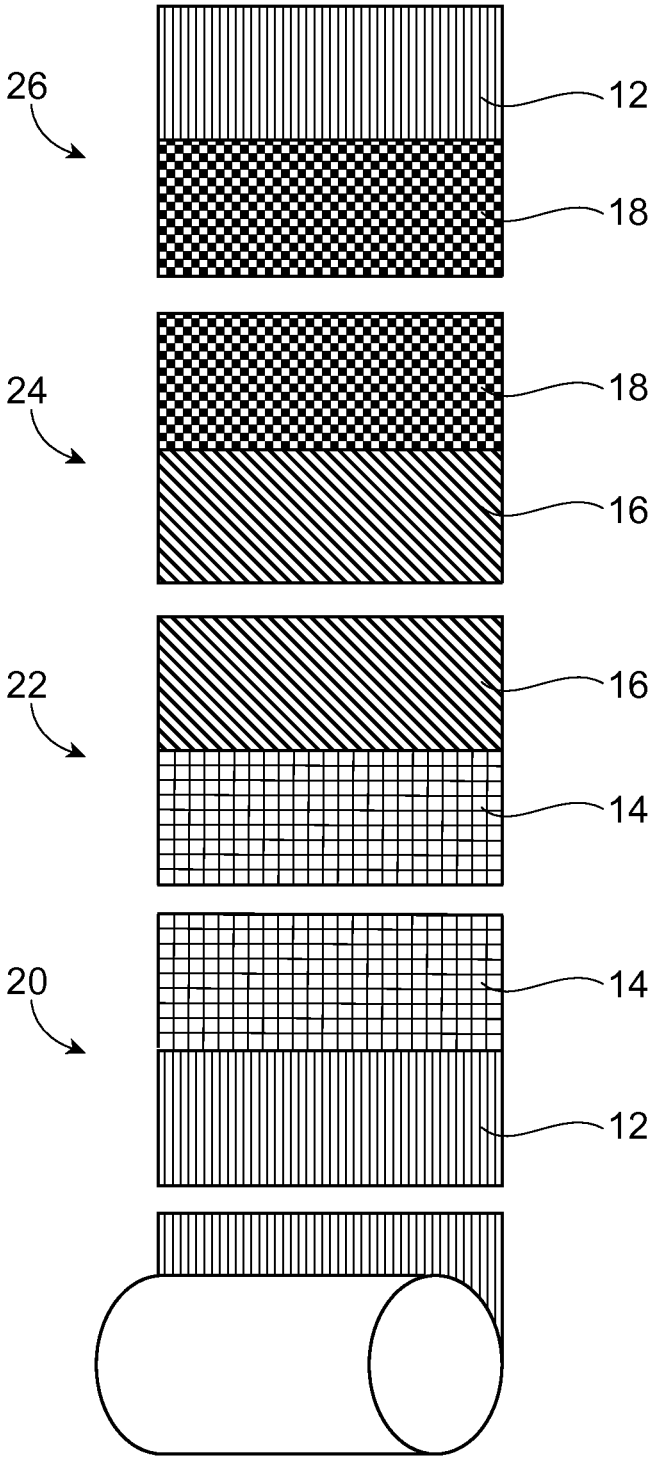
FIG. 2 is a plan view of individual wrapper materials cut from the feedstock shown in FIG. 1.

One key aspect of the methods provided herein is to cut the individual wrapper materials out of phase with the printed elements; that is, cutting feedstock substrate 10 at a location that is between, and not at, the beginning B and end E of a printed element such that only a portion of one or more particular printed elements end up on an individually wrapped article. FIG. 2 illustrates one exemplary scenario where a first wrapper material 20 comprises some of first printed element 12 and some of second printed element 14, a second wrapper material 22 includes some of second printed element 14 and some of third printed element 16, a third wrapper material 24 includes some of third printed element 16 and some of fourth printed element 18, and a fourth wrapper material 26 includes some of further printed element 18 and first printed element 12.

As shown in FIGS. 1 and 2, each of the printed elements has a length that is substantially equivalent to an individual wrapper material length such that two different printed elements are disposed on a finished wrapped article. The printed elements can alternatively have a shorter length wherein more than two different printed elements make it onto a finished wrapped article. A benefit of having only two different printed elements is that the interface of the printed elements can be used as an indicator of where the wrapper should ideally be opened.

Wrappers of the present invention can be formed by manipulating a single feedstock. For example, wrapper material feedstock 10 or individual wrapper materials (20, 22, 24, 26) cut from feedstock 10 can be folded or otherwise manipulated to form a pocket, envelope or other configuration that substantially or at least partially encloses an article. FIGS. 1 and 2 show a side of the wrapper substrate that will form an exterior of the final article wrapper. The opposing side of the wrapper substrate (that is, the side that can form an interior of the final article wrapper) can optionally also contain similar or dissimilar printed elements. Wrappers of the present invention can alternatively be formed by adhering two or more feedstock materials together to form a pocket, envelope of other container configuration. The adherence can be accomplished by use of adhesives, ultrasonics, heat, pressure, or other known techniques.

Figure 3:
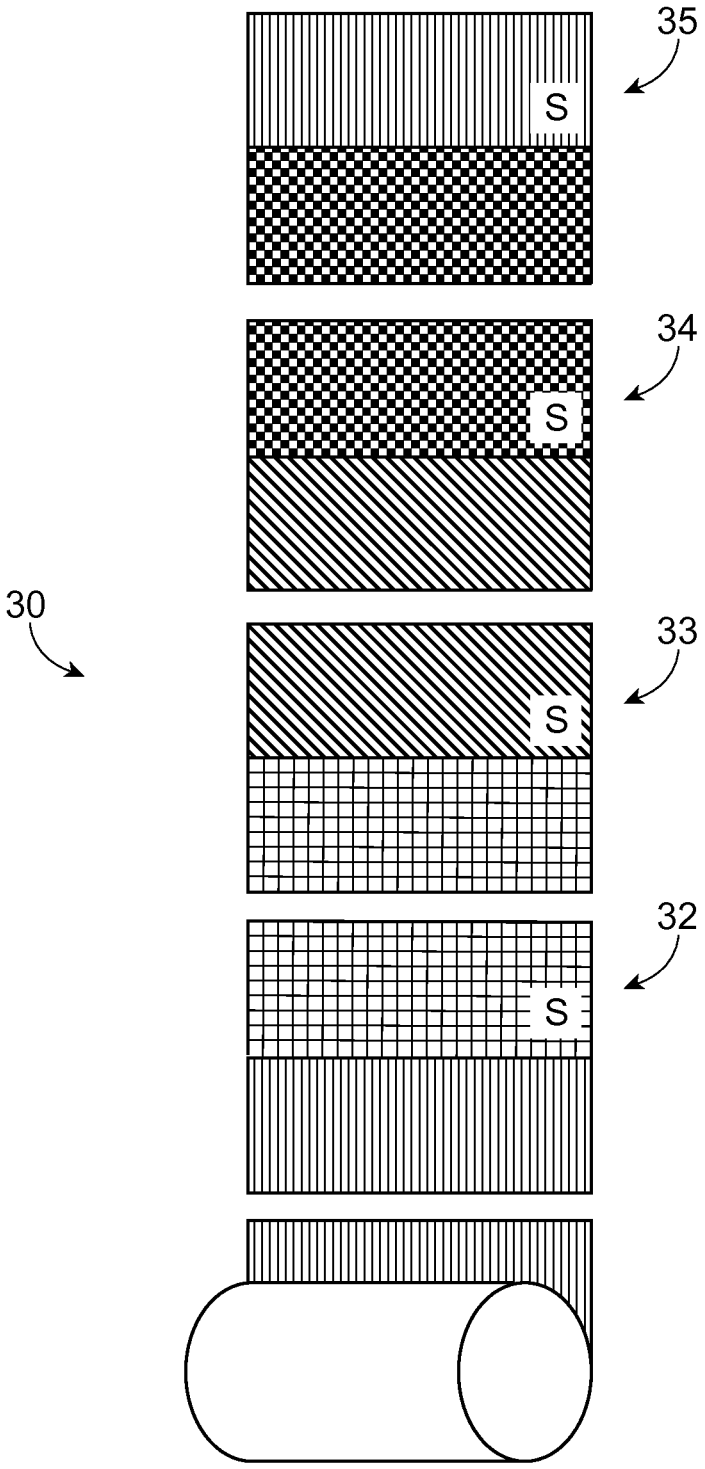
FIG. 3 is a plan view of a second wrapper feedstock embodiment according to the present invention.
Figure 4:
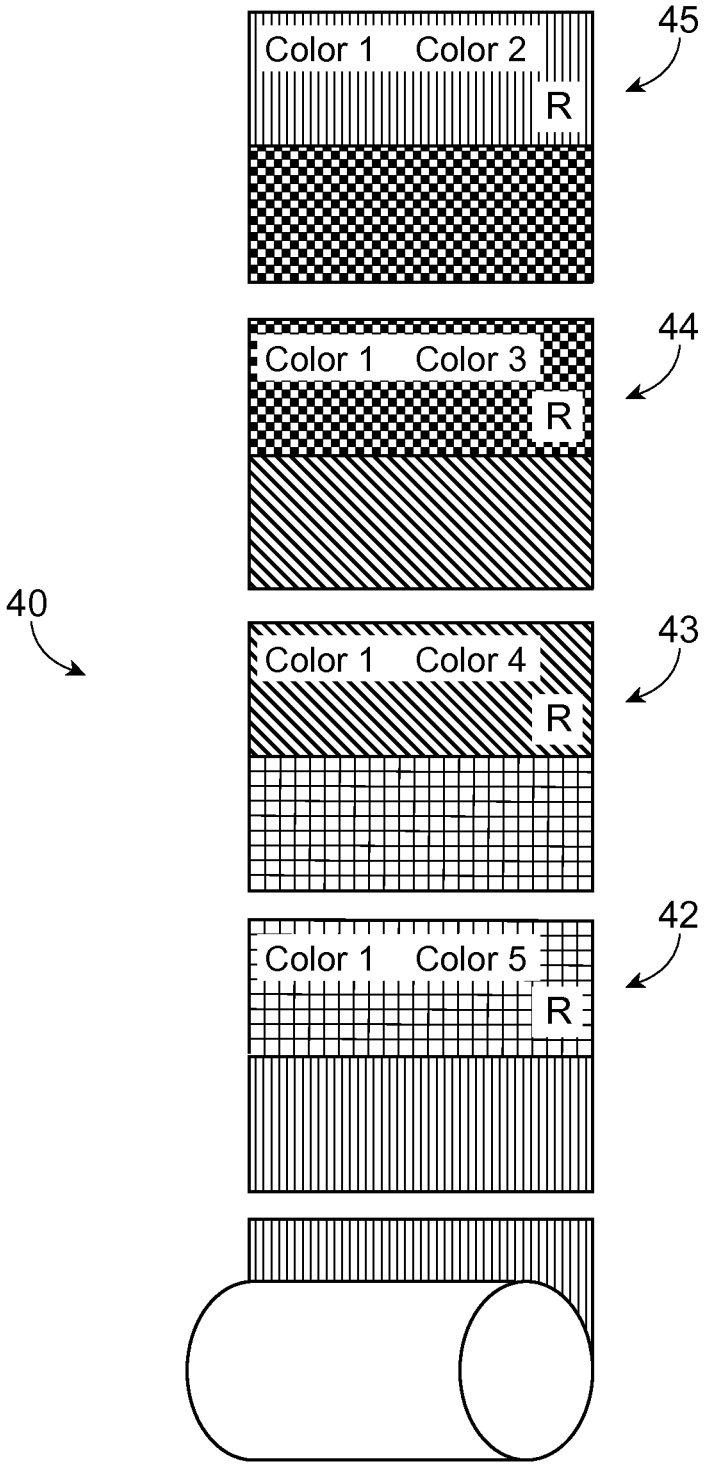
FIG. 4 is a plan view of a third wrapper feedstock embodiment according to the present invention.

FIGS. 3 and 4 are exemplary wrapper feedstocks 30 and 40, respectively. Feedstock 30 comprises four different printed elements 32, 33, 34, and 35. Feedstock 40 similarly comprises four different printed elements 42, 43, 44, and 45. As can be seen in FIGS. 3 and 4, the printed elements are different overall but do contain some common aspects. By way of example only, the printed elements in FIG. 3 have an overall different appearance (shown via cross-hatching) while including a common aspect in the form of a letter S that may communicate the size or other characteristic of the contained article. The printed elements in FIG. 4 also have an overall different appearance but contain two common aspects—a letter R and one common color 1. Some other wrapper feedstock embodiments of the present invention contain additional and/or alternative common aspects than those shown in FIGS. 3 and 4 when comparing the different printed elements, while still other embodiments contain essentially no common aspects.

Figure 5:
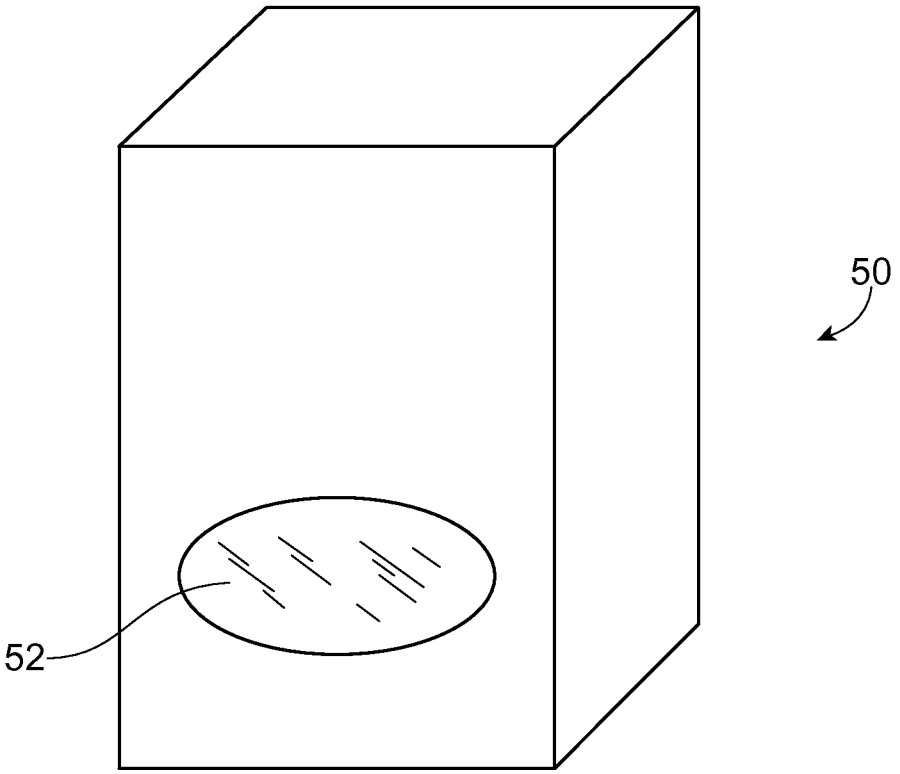
FIG. 5 is a front perspective view of a package embodiment according to the present invention.

Packages of the present invention contain a plurality of individually wrapped articles. Materials for constructing the packages and the package configurations can be any of those known by the skilled artisan. Examples include, but are not limited to, paper or board stock cartons and polymeric (e.g., polypropylene) film bags. The packages can optionally contain a window that may allow at least some of the wrapper printed elements to be seen therethrough. "Window(s)", as that term is used herein, can include complete through openings, transparent sections, translucent sections, film inserts/coverings in a cardboard carton cutout, and the like. FIG. 5 shows an exemplary carton 50 with window 52.

Figure 6:
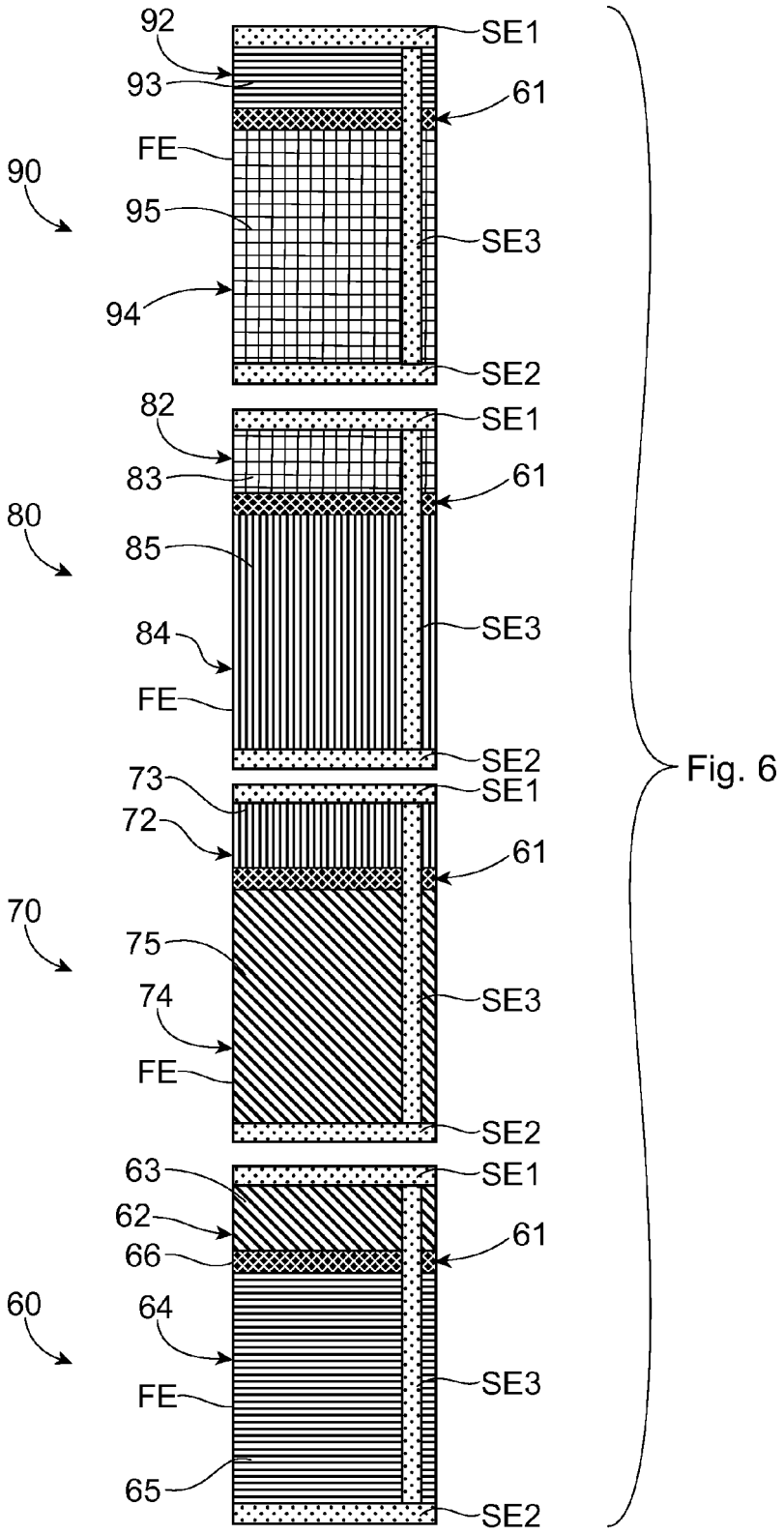
FIG. 6 is a side view of a plurality of individually wrapped articles of the present invention that can be placed into a single secondary package.

In one embodiment of the present invention package 50 comprises wrappers 60, 70, 80, and 90 as shown in FIG. 6.

Wrappers 60, 70, 80, and 90 are suitable for a number of different articles including, for example, intravaginal devices. Each of these wrappers have a folded edge FE, three sealed edges SE1, SE2, and SE3, and a perforated line 61 to facilitate opening the wrapper. Using wrapper 60 for reference, wrapper 60 also includes a first region 62 having a first printed element 63, a second region 64 having a second printed element 65, and an optional opening indicator printed element 66. Wrappers 70, 80, and 90 are labeled with similar reference numerals having similar digits in the "one's place" to that of wrapper 60 to indicate the different wrapper regions and printed elements (cross-hatching is also used to illustrate different and similar printed elements). The specific configuration of wrappers 60, 70, 80, and 90 should not be read as limitations into any of the appended claims unless explicitly recited.

Figure 7:
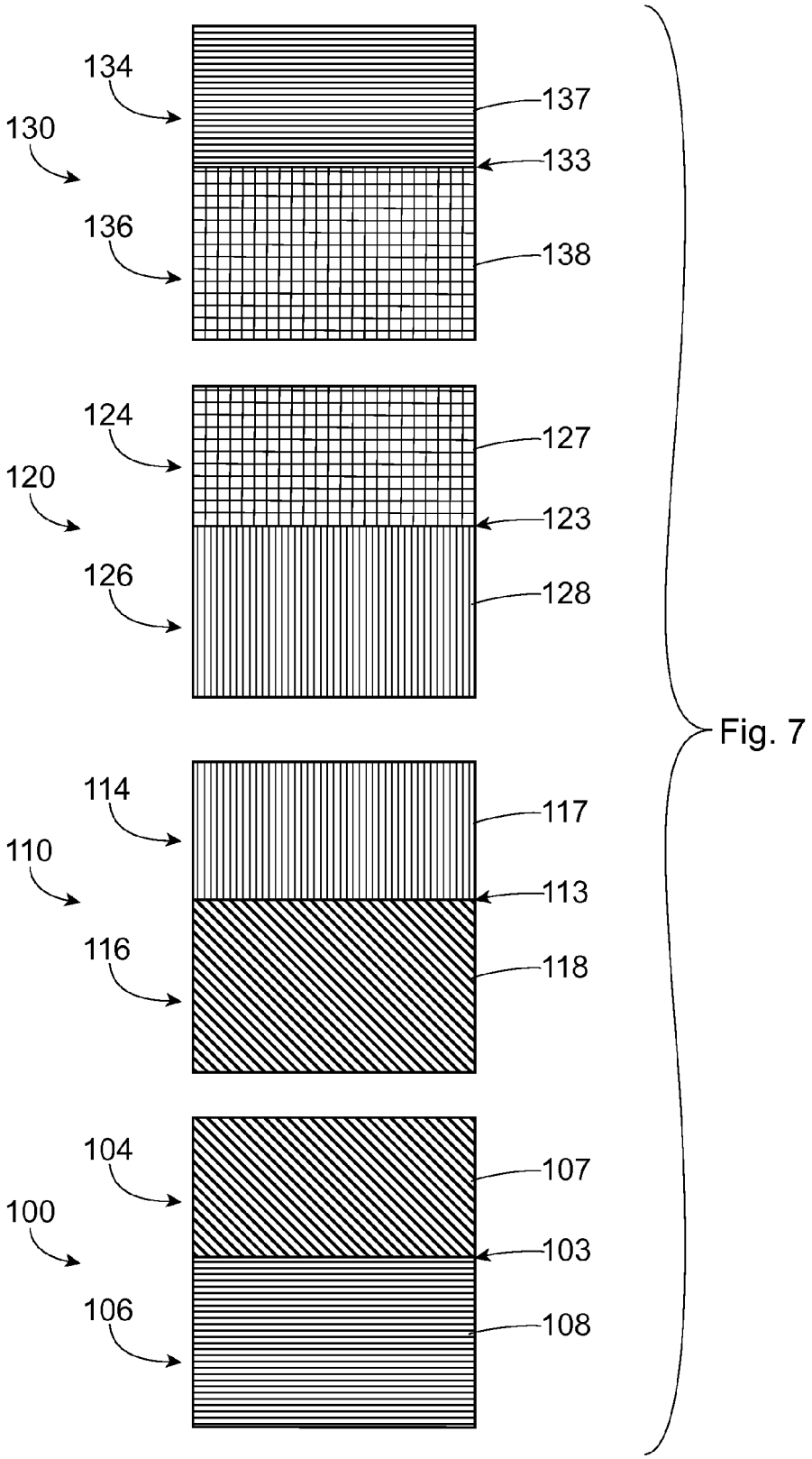
FIG. 7 is a side view of a second plurality of individually wrapped articles of the present invention that can be placed into a single secondary package.
Figure 8:
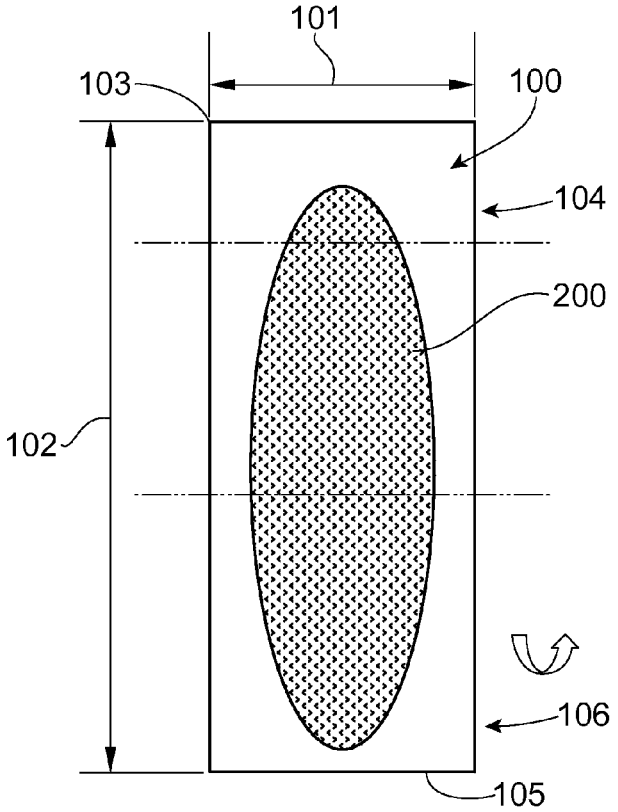
FIGS. 8-10 illustrate one of the individually wrapped articles of FIG. 7 in an unfolded configuration and two different folded configurations.
Figure 9:
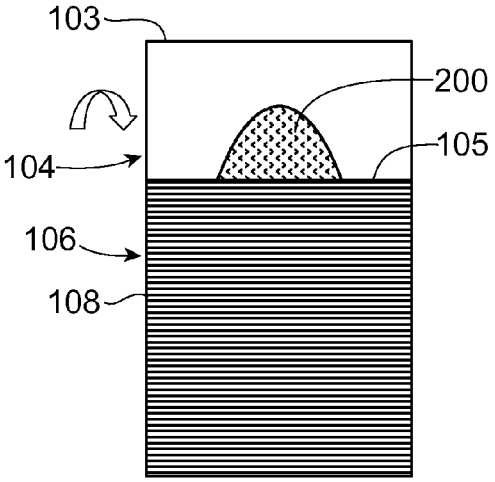
Figure 10:
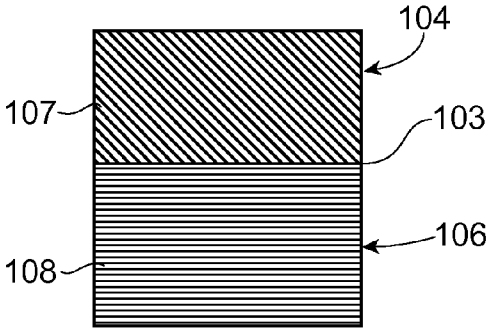

In another embodiment of the present invention package 50 comprises wrappers 100, 110, 120, and 130 shown in FIG. 7. Wrappers 100, 110, 120, and 130 are suitable for a number of different absorbent articles including diapers, pads, pantiliners, and adult incontinence devices. As shown in FIG. 8 and using wrapper 100 as a reference, an article 200, which can be placed against or proximate the skin of a consumer for managing bodily discharges, is placed in and/or adhered to wrapper 100 in an unfolded state. Wrapper 100 has a width 101, a length 102 that in one embodiment is greater than width 101, a first free edge 103 associated with a first end region 104 and a second free edge 105 associated with a second end region 106. The article and the wrapper together are tri-folded—see the first fold in FIG. 9 and the third fold in FIG. 10—wherein first free edge 103 overlaps second end region 106. First end region 104 comprises a first printed element 107 and second end region 106 comprises a second printed element 108. Free edge 103 is lifted for opening a wrapped article. As shown, first free edge 103 is devoid of any tab or extension that can optionally be associated with the same to help lift first free edge 103, particularly where adhesive or a heat seal is used to temporarily join first end region 104 to underlying second end region 106. The wrapper side edges can optionally be adhered to one another via adhesives or a heat seal, for example. Wrappers 110, 120, and 130 are labeled in FIG. 7 with similar reference numerals having similar digits in the "one's place" to that of wrapper 100 to indicate the different wrapper regions and printed elements (cross-hatching is also used to illustrate different and similar printed elements). The specific configuration of wrappers 100, 110, 120, and 130 should not be read as limitations into any of the appended claims unless explicitly recited.

Figure 11:
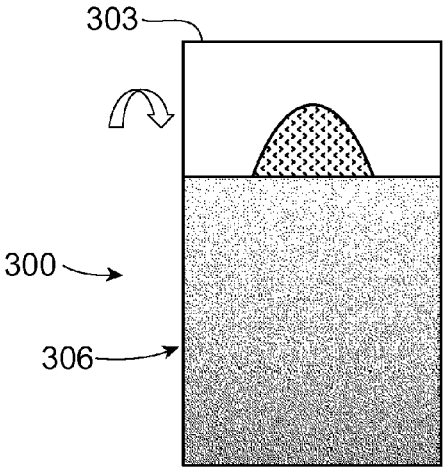
FIGS. 11 and 12 illustrate an alternative embodiment of an individually wrapped article in a partially unfolded configuration and a folded configuration.
Figure 12:
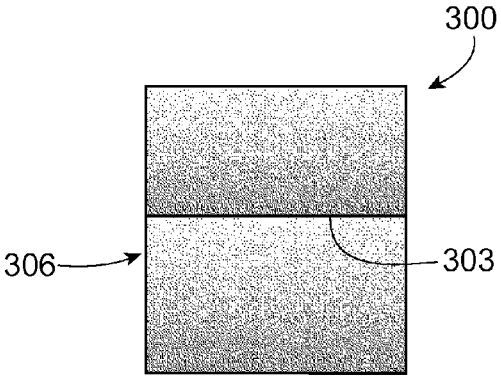

The previously-described figures show abrupt starting and stopping points of different printed elements. In alternative embodiments, there can be a gradual fade (or gradient effect) between two printed elements and/or a mix of the two printed elements proximate their interface; an example of such an embodiment is shown in FIGS. 11 and 12. The grey-scale shading on wrapped article 300 illustrates one execution of this alternative approach. The free edge 303 has a different appearance from the underlying second region 306.

The description above focused on wrapper printed elements. However, the "printed elements" may also be created by adding colorants (e.g., pigments, dyes) to the wrapper materials other than by printing. The wrapper materials may also be physically manipulated to create the appearance of a "printed element." For example, the wrapper materials may be embossed, textured, apertured, or otherwise physically-transformed such that the physical manipulation of the wrapper materials creates a "printed element" without the use of any printing.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 millimeters" is intended to mean "about 40 millimeters."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package, which is a paper or board stock carton or polymeric film bag, comprising a plurality of individually wrapped articles, said package comprising:

a. a first individually wrapped article comprising a first wrapper;

b. a second individually wrapped article comprising a second wrapper;

c. each of the first wrapper and the second wrapper comprising a first region and a second region;

d. each of the first wrapper and the second wrapper further comprising a line of weakness disposed at an interface of the first region and the second region;

e. wherein a first printed element is disposed on the first region of the first wrapper;

f. wherein a second printed element that is different from the first printed element is disposed on the second region of the first wrapper;

g. wherein the second printed element is also disposed on the first region of the second wrapper; and h. wherein a third printed element is disposed on the second region of the second wrapper and wherein the third printed element is different than the first printed element and the second printed element.

2. The package of claim 1, further comprising:

a. a third individually wrapped article comprising a third wrapper that includes a first region, a second region, and a line of weakness disposed at an interface of the first region and the second region;

b. the third printed element is disposed on the first region of the third wrapper; and c. wherein the first printed element is also disposed on the second region of the third wrapper.

3. The package of claim 1, further comprising:

a. a third individually wrapped article comprising a third wrapper;

b. a fourth individually wrapped article comprising a fourth wrapper;

c. each of the third wrapper and the fourth wrapper comprising a first region and a second region;

d. each of the third wrapper and the fourth wrapper further comprising a line of weakness disposed at an interface of the first region and the second region;

e. wherein the third printed element is disposed on the first region of the third wrapper; and f. wherein a fourth printed element that is different from the first printed element, the second printed element and the third printed element is disposed on the first region of the fourth wrapper and the second region of the third wrapper.

4. The package of claim 1, wherein the first printed element and the second printed element comprise a common letter or text.

5. The package of claim 1, wherein the first printed element and the second printed element comprise at least one common color.

6. The package of claim 3, wherein the first printed element, the second printed element, the third printed element, and the fourth printed element comprise a common letter or text.

7. The package of claim 3, wherein the first printed element, the second printed element, the third printed element, and the fourth printed element comprise at least one common color.

8. The package of claim 1, wherein the first printed element and the second printed element comprise different patterns or designs.

9. The package of claim 1, wherein the first printed element and the second printed element comprise different geometrical shapes.

10. The package of claim 1, wherein the first and second individually wrapped articles are intravaginal devices.

11. The package of claim 1, wherein the first and second individually wrapped articles are tampons having the same absorbency rating.

12. The package of claim 1, wherein each of the first wrapper and the second wrapper comprises an opening indicator printed element associated with the line of weakness to highlight its location to consumers.

13. The package of claim 1, further comprising one or more windows wherein at least a portion of the first printed element and the second printed element are visible therethrough.

14. A package, which is a paper or board stock carton or polymeric film bag, comprising a plurality of tri folded individually wrapped articles, said package comprising:

a. a first individually wrapped article comprising a first wrapper;

b. a second individually wrapped article comprising a second wrapper;

c. each of the first wrapper and the second wrapper comprising a first region and a second region;

d. each of the first wrapper and the second wrapper further comprising an opening indicator disposed at an interface of the first region and the second region;

e. wherein a first printed element is disposed on the first region of the first wrapper;

f. wherein a second printed element is disposed on the second region of the first wrapper;

g. wherein the second printed element is disposed on the first region of the second wrapper; and h. wherein a third printed element is disposed on the second region of the second wrapper and wherein the third printed element is different than the first printed element and the second printed element.

15. A package, which is a paper or board stock carton or polymeric film bag, comprising a plurality of individually wrapped articles, said package comprising:

a. a first individually wrapped article comprising a first wrapper;

b. a second individually wrapped article comprising a second wrapper;

c. each of the first wrapper and the second wrapper comprising a first region and a second region;

d. wherein a first printed element is disposed on the first region of the first wrapper;

e. wherein a second printed element is disposed on the second region of the first wrapper and is spaced apart from the first printed element;

f. wherein the second printed element is also disposed on the first region of the second wrapper; and g. wherein a third printed element is disposed on the second region of the second wrapper and wherein the third printed element is different than the first printed element and the second printed element.

16. The package of claim 15, wherein the first printed element and the second printed element comprise a common letter or text.

17. The package of claim 15, wherein the first printed element and the second printed element comprise at least one common color.

18. The package of claim 15, wherein the first printed element and the second printed element comprise different patterns or designs.

19. The package of claim 15, wherein the first printed element and the second printed element comprise different geometrical shapes.

20. The package of claim 15, wherein the first and second individually wrapped articles are tampons having the same absorbency rating.

* * * * *